US006237726B1

(12) United States Patent
Roick

(10) Patent No.: US 6,237,726 B1
(45) **Date of Patent: *May 29, 2001**

(54) RAIL BRAKE ELEMENT

(75) Inventor: Reinhard Roick, Ontario (CA)

(73) Assignee: A. Rawie GmbH & Co., Osnabruck (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/860,317

(22) PCT Filed: Jan. 26, 1996

(86) PCT No.: PCT/EP96/00322

§ 371 Date: Oct. 14, 1997

§ 102(e) Date: Oct. 14, 1997

(87) PCT Pub. No.: WO96/26856

PCT Pub. Date: Sep. 6, 1996

(30) Foreign Application Priority Data

Feb. 28, 1995 (DE) ..... 195 06 997

(51) Int. Cl.[7] ..... B61K 7/04
(52) U.S. Cl. ..... 188/38; 104/259; 188/250 G
(58) Field of Search ..... 188/165, 35, 38, 188/250 R, 256, 250 G; 104/259, 254, 258

(56) References Cited

U.S. PATENT DOCUMENTS

| | | | | |
|---|---|---|---|---|
| 1,239,448 | * | 9/1917 | Armburst | 188/256 |
| 2,762,314 | | 9/1956 | Hayes | 104/258 |
| 2,900,923 | * | 8/1959 | Hayes | 104/258 |
| 4,273,219 | * | 6/1981 | Ito | 188/256 |
| 5,597,053 | * | 1/1997 | Weng | 188/250 G |
| 5,753,018 | * | 5/1998 | Lamport | 523/149 |
| 5,865,122 | * | 2/1999 | Hudson | 104/259 |

FOREIGN PATENT DOCUMENTS

| | | | |
|---|---|---|---|
| PS834572 | | 3/1972 | (DE) . |
| 2453223 C2 | | 5/1976 | (DE) . |
| 29 24 823 | | 1/1981 | (DE) . |
| 3422230 C2 | | 12/1985 | (DE) . |
| 278913 | * | 10/1927 | (GB) ..... 177/244 |

* cited by examiner

*Primary Examiner*—Matthew C. Graham
(74) *Attorney, Agent, or Firm*—Vidas, Arrett & Steinkraus P.A.

(57) ABSTRACT

The invention relates to a rail brake element, in particular for use in rail brake buffer blocks, comprising a pair of clamping plates extending about a rail head from each side and supported against its top surface, which clamping plates are clamped against the rail head by a clamping device including a clamping bolt and a spring assembly, and include at its portion below the rail head a brake lining portion of suitable rigid friction material for engagement with the rail head, wherein the brake lining layer engages the rail head by means of a raised portion of wear material having a static friction coefficient smaller than that of the brake lining layer.

18 Claims, 2 Drawing Sheets

RAIL BRAKE ELEMENT

The invention relates to a rail brake element, in particular in connection with rail brake buffer blocks, according to the preamble of patent claim 1.

A rail brake element of the above-identified type has become known from German 24 53 223. The clamping plates which are of an approximately C-shaped cross-section are pressed together above the rail head by means of clamping bolts. In the lower area the clamping plates include angular friction elements which are made of a suitable friction material such as bronze. The friction elements engage the bottom side and the lateral surfaces of the rail head. A so-called lining piece is supported against the rail head, which lining piece is also made of friction material and has at its upper side tapered surfaces which are engaged by the upper legs of the clamping plates. When the clamping bolts are subjected to tension forces, compression and tension forces are exerted upon the friction elements by a wedge action such that a corresponding friction force will be generated at the rail head.

Modifications of such a brake element have become known from German 834 572 or German 34 22 230.

Apart from the friction coefficient the brake action of such a rail brake element depends on the force which urges the friction elements against the rail head. This force is applied via the clamping bolt, with a double spring ring being disposed between the clamping bolt and a clamping plate. The only possibility to preset the urging force is to measure the torque for tightening the clamping bolt. However, there are no defined relationships between the measured torque and the actual urging force because the measured torque depends also on other parameters such as the friction at the clamping bolt threads or the friction between the bolt head and the spring, etc. When there will be wear of the friction element, the reduced stroke will be compensated by the helical spring. If the helical spring exhibits an unfavorable force-displacement-relationship, which is the case normally with the used helical springs, wear will result in a significantly reduced urging force.

The actual braking effect by the rail brake element is obtained by displacing the rail brake element along the rail head, for example by a buffer block which either stands upon the rails relatively loosely or is integrated in the rail brake element. However, before this will occur, stationary friction will have to be overcome, with stationary friction theoretically being at least twice as large as sliding friction, however, in practice may be much higher due to corrosion of the rail and braking parts of the rail brake element. During the initial impact phase the rail brake element acts like a rigid barrier which begins to move only after the stationary friction has been overcome. This will cause a substantial shock for the oncoming vehicle. If a plurality of rail brake elements are disposed one after the other in abutting relationship, this will result in an excessive, unacceptable value of the described stationary friction. This is why it is common practice to arrange the rail brake elements in spaced relationship so that the stationary friction of the individual rail brake elements will be overcome one after the other during a braking operation.

The problem to be solved by the invention is to provide a rail brake element, in particular in connection with rail brake buffer blocks, which overcomes the above drawbacks and exhibits a relatively small stationary friction while providing for an optimal braking effect by sliding friction.

This problem is solved by the features of patent claim 1.

In the brake element of the invention the brake lining layer engages the rail head by means of at least one raised portion of wear-resistent material having a stationary friction coefficient smaller than said of the brake lining layer. According to one aspect of the invention the wear material may be made of plastics such as a suitable polyamide. It is of inventive significance that the raised portion has a relatively small friction coefficient and in particular provides for small stationary friction of the rail brake element. As a result only a relatively small impact force is necessary to cause the rail brake element to move during a braking operation. Due to the resulting sliding friction between the raised portion and the rail head, the wear material should be worn off during a relatively short path of movement of the rail brake element such that the brake lining layer will then engage the rail head to provide for the desired brake effect.

The height for which the raised portion extends above the actual brake lining layer may be very small. The compression resistence of the used wear material and its height are to be chosen such that extensive engagement between the brake lining layer and the rail head is avoided. Such an engagement should be obtained only by wear of the wear material.

In one embodiment of the invention the wear material may be applied to the brake lining layer so as to be continuous; however, in an alternative embodiment of the invention it may be applied so as to be disposed in spaced areas. Preferably, separate parts, preferably of plastics, are used, which parts are mounted to the brake lining in suitable manner. Application thereof and, respectively, re-application thereof after wear should be as simple as possible so as to be readily performable by servicing personal. In one embodiment of the invention the brake lining layer comprises a brake ledge which engages only the bottom side of the rail head; the brake ledge may be of an arcuate cross-section according to a further development of the invention. According to a further development of the invention block-like wear portions may be inserted in respective recesses of the brake ledge and secured therein for example by a press fit. It is particularly preferred to provide the block-like wear portion with a flange which cooperates with counterbores of bores in the brake ledge which are formed on the side facing the clamping plate. In this manner, the wear portion is retained in the bore of the brake ledge by the associated portion of the clamping plate. The convex arcuate shape of the brake ledge has furthermore the advantage that it has a defined surface engaging the rail head.

A further development of the invention provides that the clamping device is supported against the top side of the rail head via a pad of friction material and exerts a tension force upon the clamping plate. In this manner the urging force for the brake lining layer is not generated by a wedge effect as in the rail brake element of the above mentioned prior art, but exclusively by tension forces exerted upon clamping plates. The tension forces may be applied by a clamping bolt. It is much more acurate to set the brake force by applying an urging force than by generating a wedge effect as in the prior art. In an embodiment of the invention the pad cooperates with the clamping bolt which is disposed in a threaded bore of a lining ledge above which the clamping plate extends and the outside of which is connected to the clamping plates, with the pad being received in a recess of the lining ledge and a compression spring being disposed between the clamping bolt and the pad. According to a further development of the invention the compression spring may comprise a Belleville spring assembly which exhibits a favorable force-displacement-characteristic. The pad which provides for a braking action can be provided also with a raised wear portion as described above in connection with the brake lining, in order to reduce stationary friction also at this location. Preferably, in an elongated rail brake element there are provided a plurality of pads in spaced relationship, each in connection with a clamping bolt and a Belleville spring assembly.

Generating an urging force by the clamping bolt has the advantage that the urging force is proportional to the distance for which the brake element has moved. This distance may be measured in a simple manner. To this end a further development of the invention provides that the clamping bolt is hollow and an indicator rod extends through the clamping bolt to the pad, and securing means are positioned between the clamping bolt head and the indicator rod to prevent the indicator rod from dropping through the clamping bolt. The relative positions of the indicator rod and the clamping bolt are a measure for the distance for which the clamping bolt moves when it is tightened. In this manner a measure for the urging force and accordingly for the brake force between the brake lining layer and the rail head is obtained. The securing means prevents the indicator rod from dropping through the clamping bolt before final assembly. A press fit between the indicator rod and the pad enables to retain the pad on the clamping bolt before the unit has been assembled.

In the following the invention will be explained in more detail with reference to drawings.

Figure 2:
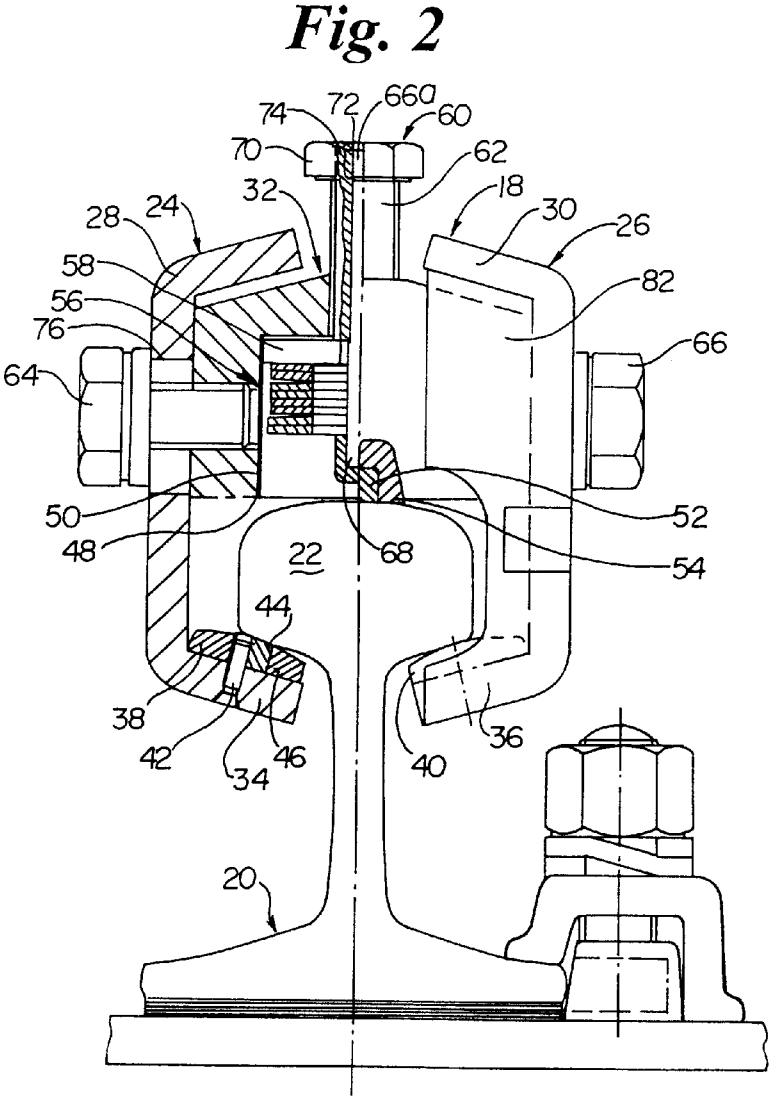
FIG. 2 shows the rail brake element of FIG. 1, partially in cross-section, for a third type of rail.
Figure 1:
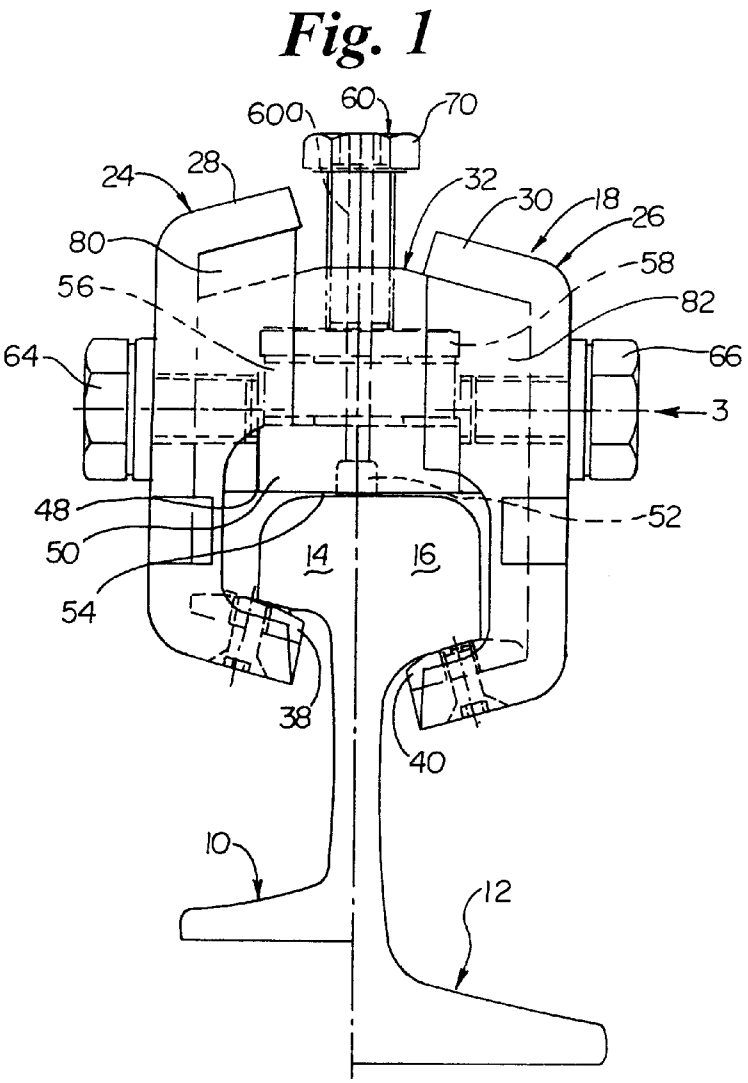
FIG. 1 shows an end elevation of a rail brake element of the invention for a pair of different rails.
Figure 3:
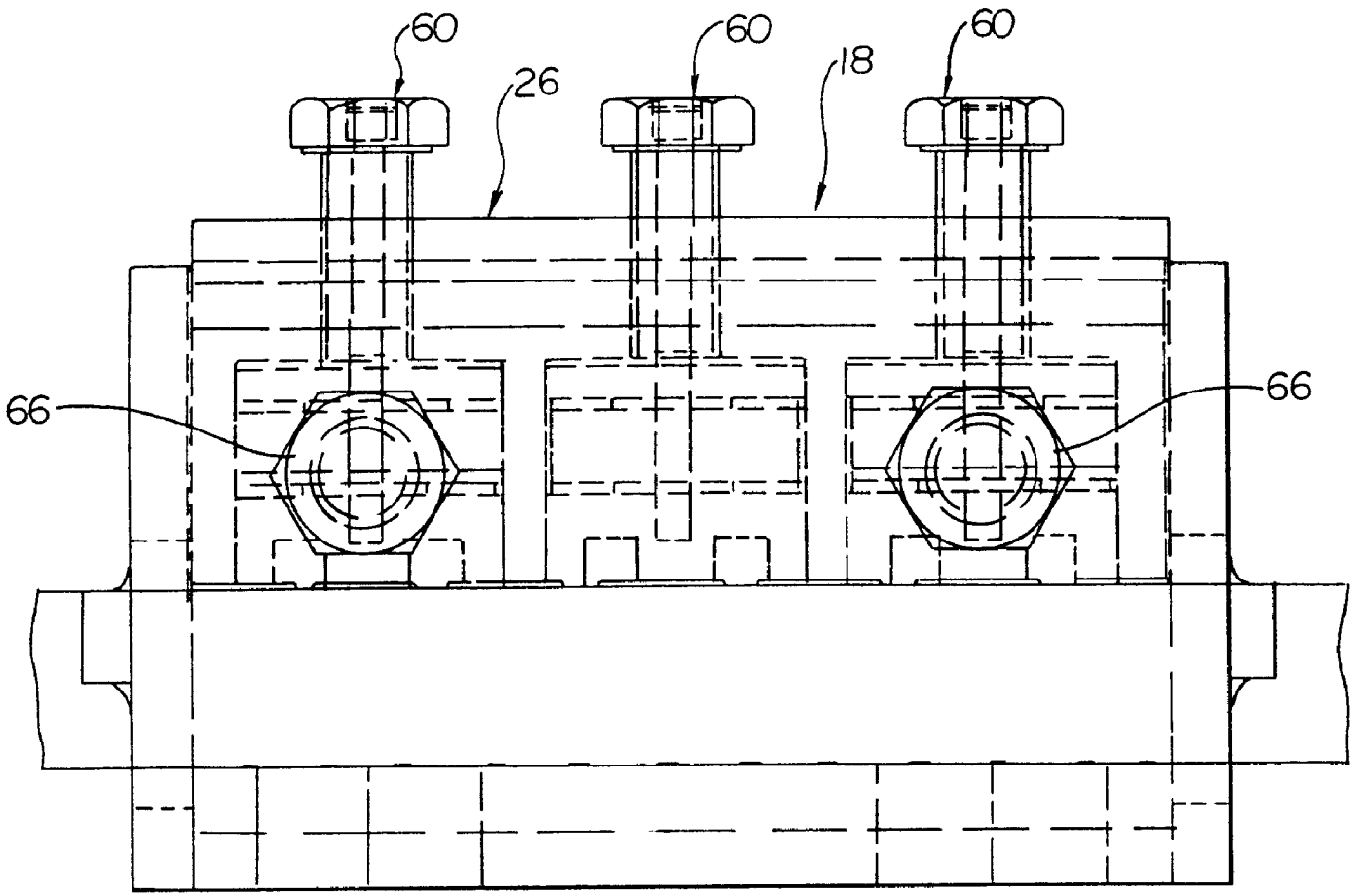
FIG. 3 is a side elevation of the rail brake element of FIG. 1 in the direction of arrow 3.

FIG. 1 shows, in cross-section, a first rail 10 (left-hand side) and a second rail 12 (right-hand side) including a rail head 14 and 16, respectively. Identical rail brake elements 18 are provided for both rail heads 14, 16. FIG. 2 shows a third rail 20 having a rail head 22 for which an identical rail brake element 18 is used. Accordingly it is usable universally. It includes on opposite sides of the rail head clamping plates 24, 26 which are of an approximately C-shaped cross-section and terminate at their ends in inwards extending flanges 80, 82. Upper legs 28 and 30 of the clamping plates 24 and 26 extend above a lining ledge 32 which has roof surfaces at its upper side. Brake lining layers 38 and 40 forming brake ledges are mounted to the lower legs 34, 36 of the clamping plates 24, 26 by bolts as indicated at 42. In FIG. 1 the bolts are shown by dotted lines. As shown the brake ledges which are made of a suitable friction material such as bronze are of convex arcuate shape at their outsides and engage only the bottom side of rail head 14, 16 and 22, respectively.

As may be seen in FIG. 2 on the left-hand side, the ledges of the brake lining layers 38, 40 include bores which receive block-like wear portions forming raised portions. The wear portions 44 which are of circular cross-section include at their sides facing the clamping plate 24 a flange 46 which is received in the corresponding recess or counterbore of the brake ledge. As a result the wear portions 4 are securely retained in the brake ledge. Each brake ledge may comprise a row of such wear portions 44 spaced in the longitudinal direction. They are made of a suitable plastic material such as polyamide which exhibits a relatively high pressure compression resistence. They project only slightly above the arcuate top side of the brake ledges (see FIG. 1 and right-hand side of FIG. 2), provide, however, the only contact surface at the bottom side of the rail head 14, 16 or 22, respectively.

The lining ledge 32 extending along the length of the clamping plates 24, 26 has at its bottom side three spaced circular recesses 48 which receive cylindrical pads 50. They are made of suitable friction material such as bronze. Block-like wear portions 52 of a suitable compression resistent plastics material such as polyamide are inserted into the bottom side of the pads 50 and are retained therein by a pressfit. Outwardly extending flanges forming raised portion provide for the only contact surface between the pads 50 and the rail head 14, 16 and 22, respectively.

A compression spring 56 and a compression disk 58 forming a Belleville spring assembly are received in the recesses 48 above the pads 50. Supported against the compression disk 58 is a clamping bolt 60 the shaft 62 of which is received in a threaded bore of the lining ledge 32. The clamping bolt 60 exerts a pressure force upon the pad 50 via the compression disk 58. Since the lining ledge 32 is connected to the clamping plates 24, 26 via bolts 64 and 66, respectively, a tension force is exerted upon the latter, which causes the brake ledges to exert an urging force against the bottom side of the rail head 14, 18 or 22, respectively.

The clamping bolts 60 are hollow and receive an indicator rod 66*a* which is received in a bore of the pad 50 by a press-fit at the lower end at 68. In the area of the head 70 of the clamping bolt 60 securing means 72 ensure that the indicator rod 66*a* cannot drop through the clamping bolt 60. The securing means 72 comprises a resilient ring or the like which contacts a shoulder 74 of the clamping bolt 60 when it is being moved downwards for a predetermined distance.

The shafts of the threaded bolts 64, 66 extend through over-dimensioned apertures 76 of the clamping plates 24, 26. The lining ledge 32, the clamping bolt 60, the compression disk 58, the Belleville spring assembly and the pads 50 form a unit premounted before the-rail brake element 18 is mounted to the rail head 14, 16, 22. The described unit will be positioned upon the rail head, and thereafter the clamping plates 24, 26 are mounted thereto by means of the bolts 64, 66. Tightening of the clamping bolts 60 as described results in an urging force being exerted upon the pads 50 and the brake ledges, with the distance for which the clamping bolt 60 has moved being a measure for such a force. This distance may be measured now by the indicator rod which rests upon the pad 50.

When a braking operation will occur in that for example a rail brake buffer block moved by a vehicle is urged on one side against the clamping plates 24, 26, it is necessary initially to overcome the stationary friction. The latter is determined exclusively by the block-like wear portions. Since these exhibit a very small friction coefficient, the impact force for starting the rail brake element 18 to move is relatively small. A small friction distance, however, is sufficient for the raised portions 44, 54 of the wear portions to wear off so that the brake ledges and, respectively, the pad 50 will frictionally cooperate with the rail head 14, 16 or 22, respectively.

After such a brake operation it is necessary to exchange the wear elements.

What is claimed is:

1. A rail brake element, for use in rail brake buffer blocks, comprising a pair of clamping plates extending about a rail head from each side and supported against its top surface, which clamping plates are clamped against the rail head by a clamping device including a clamping bolt and a spring assembly, and include at its portion below the rail head a brake lining portion of rigid friction material for engagement with the rail head, characterized in that the brake lining layer (38,40) engages the rail head (14, 16, 22) by means of a raised portion (44) of wear material having a static friction coefficient smaller than that of the brake lining layer (38,40), the brake lining layer, the wear material constructed and arranged to engage the rail head for a single engagement (38, 40) contacting the rail head only after the raised portion of wear material has been worn away by frictional engagement with the rail head.

2. A rail brake element according to claim 1, characterized in that the wear material comprises compression resistant plastics.

3. A rail brake element according to claim 1, characterized in that the wear material is applied to the brake lining layer so as to be continuous.

4. A rail brake element according to claim 1, characterized in that the wear material is applied to the brake lining layer in spaced areas.

5. A rail brake use element according claim 1, characterized in that the brake lining layer (38,40) comprises a brake ledge facing only the bottom side of the rail head (14,16,22).

6. A rail brake element according to claim 5, characterized in that block-like wear portions forming raised portions (44) are inserted in recesses of the brake ledge.

7. A rail brake element according to claim 6, characterized in that the block-like wear portions are press-fitted into the recesses.

8. A rail brake element according to claim 6, characterized in that the recesses are throughbores in the brake ledge and the block-like wear portions include a flange (46) which is received in a counterbore of the bores on the side facing the clamping plate (24,26).

9. A rail brake element according to claim 5, characterized in that the side of the brake ledge which faces the rail head (14,16,22) is of a convex arcuate cross-section.

10. A rail brake element according to any of claim 1, characterized in that the clamping device is supported against the top surface of the rail head (14,16,22) via a pad (50) of friction material and exerts a tension force upon the clamping plates (24,26).

11. A rail brake element according to claim 10, characterized in that a clamping bolt (60) engages the pad (50), which clamping bolt is received in a threaded bore of a lining ledge (32) across which the clamping plates (24,26) extend and which is connected to the outside of the clamping plates (24,26), the pad (50) being received in a recess (48) of the lining ledge (32) and a compression spring (56) being disposed between the clamping bolt (60) and the pad (50).

12. A rail brake element according to claim 11, characterized in that the pad (50) has a raised portion (54) resting upon the rail head (14,16,22), which raised portion is of a wear material of a small static friction coefficient.

13. A rail brake element according to claim 11, characterized in that the compression spring (56) comprises a Belleville spring assembly.

14. A rail brake element according to any of claim 11, characterized in that the clamping bolt (60) is hollow and an indicator rod (66*a*) extends through the clamping bolt (60) to the pad (50), and securing means (72) are positioned between the clamping bolt head (70) and the indicator rod (66*a*) to prevent the indicator rod (66*a*) from dropping through the clamping bolt (60).

15. A rail brake element according to claim 14, characterized in that the indicator rod (66*a*) is press-fitted into a bore of the pad (50).

16. A rail brake element according to any of claims 11, characterized in that a plurality of cylindrical pads (50) spaced with respect to each other are received in respective recesses (48) of the lining ledge (32).

17. A rail brake element according to any of claims 11, characterized in that the lining ledge (32) is connected to the clamping plates (24,26) by means of threaded bolts (64,66) and the apertures (76) in the clamping plates (24,26) for receiving the threaded bolts (64,66) are of a diameter in excess of the diameter of the bolt shafts.

18. A rail brake element, for use in rail brake buffer blocks, comprising:

a pair of clamping plates extending about a rail head from each side and supported against its top surface, the clamping plates being clamped against the rail head by a clamping device including a clamping bolt and a spring assembly, the portion of the clamping device below the rail head including a brake lining portion of rigid friction material for engagement with the rail head, the brake lining layer (38,40) engaging the rail head (14, 16, 22) by means of a raised portion (44) of wear material comprised of compression resistant plastics and having a static friction coefficient smaller than that of the brake lining layer (38,40), the brake lining layer (38, 40) contacting the rail head only after the raised portion of wear material has been worn away by frictional engagement with the rail head.

* * * * *